US010548442B2

(12) United States Patent
Conrad

(10) Patent No.: US 10,548,442 B2
(45) Date of Patent: Feb. 4, 2020

(54) PORTABLE SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 234 days.

(21) Appl. No.: 15/012,783

(22) Filed: Feb. 1, 2016

(65) Prior Publication Data

US 2016/0143495 A1 May 26, 2016

Related U.S. Application Data

(63) Continuation of application No. 14/874,544, filed on Oct. 5, 2015, now Pat. No. 9,826,868, which is a (Continued)

(30) Foreign Application Priority Data

Mar. 13, 2009 (CA) ..... 2658372

(51) Int. Cl.
*A47L 5/24* (2006.01)
*A47L 5/32* (2006.01)
(Continued)

(52) U.S. Cl.
CPC ..... *A47L 5/24* (2013.01); *A47L 5/225* (2013.01); *A47L 5/28* (2013.01); *A47L 5/32* (2013.01);
(Continued)

(58) Field of Classification Search
CPC ... A47L 5/225; A47L 5/24; A47L 5/28; A47L 9/02; A47L 9/1608; A47L 9/322; A47L 9/1683; A47L 9/1666
(Continued)

(56) References Cited

U.S. PATENT DOCUMENTS 2,071,975 A 2/1937 Holm-Hansen et al.
2,533,057 A 12/1950 Senne
(Continued)

FOREIGN PATENT DOCUMENTS

CA 1218962 A1 3/1987
CA 2241644 C 12/2007
(Continued)

OTHER PUBLICATIONS

International Search Report, received in connection to corresponding International Patent Application No. PCT/CA2010/000342, dated Jun. 17, 2010.
(Continued)

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

A hand vacuum cleaner having an air treatment member positioned in the air flow passage upstream from a suction motor and comprising a dirt chamber having an openable door, wherein an openable lock securing the door in a closed position is provided. A hand vacuum cleaner having a cyclonic stage and a suction motor, wherein the cyclone unit is mounted to a motor housing wherein a projection of the motor axis extends through the cyclonic stage is also provided.

20 Claims, 10 Drawing Sheets

Related U.S. Application Data continuation of application No. 13/255,875, filed as application No. PCT/CA2010/000342 on Mar. 9, 2010, now Pat. No. 9,204,769.

(51) Int. Cl.

| | |
|---|---|
| ***A47L 9/02*** | (2006.01) |
| ***A47L 9/16*** | (2006.01) |
| ***A47L 9/10*** | (2006.01) |
| ***A47L 9/32*** | (2006.01) |
| ***A47L 5/22*** | (2006.01) |
| ***A47L 5/28*** | (2006.01) |

(52) U.S. Cl.
CPC ..... *A47L 9/02* (2013.01); *A47L 9/106* (2013.01); *A47L 9/1608* (2013.01); *A47L 9/1666* (2013.01); *A47L 9/1683* (2013.01); *A47L 9/1691* (2013.01); *A47L 9/322* (2013.01)

(58) Field of Classification Search
USPC ..... 15/344
See application file for complete search history.

(56) References Cited

U.S. PATENT DOCUMENTS 2,542,634 A 2/1951 Davis et al.
2,559,384 A 4/1951 Senne
2,621,756 A 12/1952 Senne
2,632,524 A 3/1953 Senne
2,913,111 A 11/1959 Rogers
2,942,691 A 6/1960 Dillon
3,015,122 A 1/1962 Cook
3,085,221 A 4/1963 Kelly
3,130,157 A 4/1964 Kelsall et al.
3,200,568 A 8/1965 McNeil
3,310,828 A 3/1967 Clark
3,320,727 A 5/1967 Farley et al.
3,356,334 A 12/1967 Scaramucci
3,457,744 A 7/1969 Bisbing
3,530,649 A 9/1970 Porsch et al.
3,582,616 A 6/1971 Wrob
3,822,533 A 7/1974 Oranje
3,898,068 A 8/1975 McNeil et al.
3,988,132 A 10/1976 Oranje
3,988,133 A 10/1976 Schady
4,187,088 A 2/1980 Hodgson
4,236,903 A 12/1980 Malmsten
4,373,228 A 2/1983 Dyson
4,393,536 A 7/1983 Tapp
4,443,910 A 4/1984 Fitzwater
4,573,236 A 3/1986 Dyson
4,635,315 A 1/1987 Kozak
4,809,393 A 3/1989 Goodrich et al.
4,809,398 A 3/1989 Linduist et al.
4,826,515 A 5/1989 Dyson
4,831,685 A 5/1989 Bosyj et al.
4,836,515 A 5/1989 Dyson
4,905,342 A 3/1990 Ataka
5,054,157 A 10/1991 Werner et al.
5,078,761 A 1/1992 Dyson
5,129,125 A 7/1992 Akira et al.
5,230,722 A 7/1993 Yonkers
5,254,019 A 10/1993 Noschese
5,287,591 A 2/1994 Rench et al.
5,309,600 A 5/1994 Weaver et al.
5,309,601 A 5/1994 Hampton et al.
5,331,714 A 7/1994 Essex et al.
5,524,321 A 6/1996 Weaver et al.
5,715,566 A 2/1998 Weaver et al.
5,836,047 A 11/1998 Lee et al.
5,842,254 A 12/1998 Lee
5,858,038 A 1/1999 Dyson et al.
5,946,771 A * 9/1999 Bosyj ..... A47L 5/28 15/347
6,058,559 A 5/2000 Yoshimi et al.
6,065,251 A * 5/2000 Kindrick ..... A47K 3/001 108/157.13
6,070,291 A 6/2000 Bair et al.
6,080,022 A 6/2000 Shaberman et al.
6,081,961 A 7/2000 Wang
6,192,550 B1 2/2001 Hamada et al.
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,256,832 B1 7/2001 Dyson
6,295,692 B1 10/2001 Shideler
6,406,505 B1 6/2002 Oh et al.
6,434,785 B1 8/2002 Vandenbelt et al.
6,440,197 B1 8/2002 Conrad et al.
6,463,622 B2 10/2002 Wright et al.
6,482,246 B1 11/2002 Dyson et al.
6,510,583 B2 1/2003 Griffith et al.
6,531,066 B1 3/2003 Saunders et al.
6,553,612 B1 4/2003 Dyson et al.
6,560,818 B1 5/2003 Hasko
6,581,239 B1 6/2003 Dyson et al.
6,599,338 B2 7/2003 Oh et al.
6,623,539 B2 9/2003 Lee et al.
6,736,873 B2 5/2004 Conrad et al.
6,740,144 B2 5/2004 Conrad et al.
6,746,500 B1 6/2004 Park et al.
6,782,583 B2 8/2004 Oh
6,782,585 B1 8/2004 Conrad et al.
6,832,408 B2 12/2004 Roney et al.
6,833,015 B2 12/2004 Oh et al.
6,848,146 B2 2/2005 Wright et al.
6,874,197 B1 4/2005 Conrad
6,902,596 B2 6/2005 Conrad et al.
6,929,516 B2 8/2005 Bruchu et al.
6,961,975 B2 11/2005 Park et al.
6,976,885 B2 12/2005 Lord
7,039,985 B2 5/2006 Hisrich et al.
7,073,226 B1 7/2006 Lenkiewicz et al.
7,127,397 B2 10/2006 Case
7,131,165 B2 11/2006 Wright et al.
7,146,681 B2 12/2006 Wright et al.
7,160,346 B2 1/2007 Park
7,207,083 B2 4/2007 Hayashi et al.
7,222,393 B2 5/2007 Kaffenberger et al.
7,247,181 B2 7/2007 Hansen
7,278,181 B2 10/2007 Harris et al.
7,309,365 B2 12/2007 Yuasa et al.
7,370,387 B2 5/2008 Walker et al.
7,377,008 B2 5/2008 Park et al.
7,380,308 B2 6/2008 Oh et al.
7,381,234 B2 6/2008 Oh
7,386,916 B2 6/2008 Bone
D581,609 S 11/2008 Conrad
7,448,363 B1 11/2008 Rassmussen et al.
7,485,164 B2 2/2009 Jeong et al.
7,547,338 B2 6/2009 Kim et al.
7,581,286 B2 9/2009 Choi
7,584,522 B1 9/2009 Weeter
7,594,296 B2 9/2009 Park
7,597,730 B2 10/2009 Yoo et al.
7,604,675 B2 10/2009 Makarov et al.
7,624,475 B2 12/2009 Choi
7,645,311 B2 1/2010 Oh et al.
7,686,858 B2 3/2010 Oh
7,731,769 B2 6/2010 Min
7,779,505 B2 8/2010 Krebs et al.
7,882,592 B2 2/2011 Hwang et al.
7,887,612 B2 2/2011 Conrad
7,922,794 B2 4/2011 Morphey
7,934,286 B2 5/2011 Yoo et al.
7,941,895 B2 5/2011 Conrad
7,979,953 B2 7/2011 Yoo
8,032,981 B2 10/2011 Yoo
8,032,983 B2 10/2011 Griffith et al.
8,048,180 B2 11/2011 Oh et al.
8,062,398 B2 11/2011 Luo et al.

(56) References Cited

U.S. PATENT DOCUMENTS 8,100,999 B2 1/2012 Ashbee et al.
8,117,713 B2 2/2012 Kasper et al.
8,127,397 B2 3/2012 Hess et al.
8,127,398 B2 3/2012 Conrad
8,166,607 B2 5/2012 Conrad
8,191,203 B2 6/2012 Yoo
8,282,697 B2 * 10/2012 Oh ..... A47L 9/1625 15/352
8,347,455 B2 1/2013 Dyson et al.
8,359,705 B2 1/2013 Conrad
8,444,731 B2 5/2013 Gomiciaga-Pereda et al.
8,468,646 B2 6/2013 Yoo
8,484,799 B2 7/2013 Conrad
8,528,160 B2 9/2013 Conrad
8,769,767 B2 7/2014 Conrad
8,819,891 B2 * 9/2014 Parkinson ..... A47L 5/38 15/301
2002/0011053 A1 1/2002 Oh
2002/0062531 A1 5/2002 Oh
2002/0112315 A1 8/2002 Conrad
2002/0134059 A1 9/2002 Oh
2002/0162188 A1 11/2002 Harmen
2002/0178535 A1 12/2002 Oh et al.
2002/0178698 A1 12/2002 Oh et al.
2002/0178699 A1 12/2002 Oh
2003/0028994 A1 2/2003 Kitamura et al.
2003/0066273 A1 4/2003 Choi et al.
2003/0158238 A1 8/2003 Hale et al.
2003/0159411 A1 8/2003 Hansen et al.
2004/0010885 A1 1/2004 Hitzelberger et al.
2004/0025285 A1 2/2004 McCormick et al.
2004/0078921 A1 4/2004 Yuasa et al.
2004/0163201 A1 * 8/2004 Murphy ..... A47L 5/36 15/327.2
2004/0194249 A1 10/2004 Lee et al.
2004/0216263 A1 11/2004 Best
2004/0216264 A1 * 11/2004 Shaver ..... A47L 5/14 15/344
2004/0216266 A1 11/2004 Conrad
2005/0081321 A1 4/2005 Milligan et al.
2005/0138757 A1 6/2005 Lee
2005/0144754 A1 7/2005 Ivarsson et al.
2005/0198769 A1 9/2005 Lee et al.
2005/0252179 A1 11/2005 Oh et al.
2006/0005346 A1 1/2006 Rupp et al.
2006/0037172 A1 2/2006 Choi
2006/0042206 A1 3/2006 Arnold et al.
2006/0075598 A1 4/2006 Follegot et al.
2006/0080947 A1 4/2006 Lee et al.
2006/0090290 A1 5/2006 Lau
2006/0123590 A1 6/2006 Fester et al.
2006/0137304 A1 6/2006 Jeong et al.
2006/0137305 A1 6/2006 Jung
2006/0137306 A1 6/2006 Jeong et al.
2006/0137307 A1 6/2006 Jeong et al.
2006/0137309 A1 6/2006 Jeong et al.
2006/0137314 A1 6/2006 Conrad et al.
2006/0156508 A1 * 7/2006 Khalil ..... A47L 5/24 15/353
2006/0156509 A1 7/2006 Luebbering et al.
2006/0156699 A1 7/2006 Kim
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230724 A1 10/2006 Han et al.
2006/0230726 A1 10/2006 Oh et al.
2006/0236663 A1 10/2006 Oh
2006/0248678 A1 11/2006 Park
2006/0278081 A1 12/2006 Han et al.
2007/0012002 A1 1/2007 Oh et al.
2007/0012003 A1 1/2007 Oh et al.
2007/0033765 A1 2/2007 Walker et al.
2007/0039120 A1 2/2007 Choi
2007/0067944 A1 3/2007 Kitamura
2007/0067945 A1 3/2007 Kasper et al.
2007/0077810 A1 4/2007 Gogel et al.
2007/0079473 A1 4/2007 Min
2007/0079584 A1 4/2007 Kim
2007/0079585 A1 * 4/2007 Oh ..... A47L 9/1625 55/345
2007/0079587 A1 4/2007 Kim
2007/0084161 A1 4/2007 Yoo
2007/0095028 A1 5/2007 Kim
2007/0095029 A1 * 5/2007 Min ..... A47L 9/122 55/345
2007/0095030 A1 5/2007 Oh
2007/0226947 A1 10/2007 Kang
2007/0240275 A1 10/2007 Willenburg
2007/0251048 A1 11/2007 Choi
2007/0271724 A1 * 11/2007 Hakan ..... A47L 5/225 15/329
2007/0289085 A1 12/2007 Yoo
2007/0289264 A1 12/2007 Oh
2007/0289266 A1 * 12/2007 Oh ..... A47L 9/1608 55/337
2008/0172821 A1 1/2008 Kang et al.
2008/0040883 A1 * 2/2008 Beskow ..... A47L 5/225 15/329
2008/0047091 A1 2/2008 Nguyen
2008/0083085 A1 4/2008 Genn
2008/0104793 A1 5/2008 Kang et al.
2008/0115312 A1 5/2008 DiPasquale et al.
2008/0134460 A1 6/2008 Conrad
2008/0134462 A1 6/2008 Jansen et al.
2008/0172992 A1 7/2008 Conrad
2008/0172995 A1 7/2008 Conrad
2008/0178416 A1 7/2008 Conrad
2008/0178420 A1 7/2008 Conrad
2008/0184893 A1 8/2008 Oh
2008/0190080 A1 8/2008 Oh et al.
2008/0196194 A1 8/2008 Conrad
2008/0196195 A1 8/2008 Conrad
2008/0209666 A1 9/2008 Conrad
2008/0216282 A1 9/2008 Conrad
2008/0244858 A1 10/2008 Shaver et al.
2008/0256744 A1 10/2008 Rowntreer et al.
2009/0000054 A1 1/2009 Hampton et al.
2009/0031522 A1 2/2009 Yoo
2009/0044371 A1 2/2009 Yoo et al.
2009/0106932 A1 4/2009 Courtney
2009/0113659 A1 5/2009 Jeon et al.
2009/0144929 A1 6/2009 Yoo
2009/0144932 A1 6/2009 Yoo
2009/0205160 A1 8/2009 Conrad
2009/0205161 A1 8/2009 Conrad
2009/0241284 A1 10/2009 Mayes
2009/0265877 A1 10/2009 Dyson et al.
2009/0282639 A1 11/2009 Dyson et al.
2009/0289089 A1 11/2009 Fullerton et al.
2009/0300873 A1 12/2009 Grey
2009/0307864 A1 12/2009 Dyson
2010/0005611 A1 1/2010 Hong et al.
2010/0043170 A1 2/2010 Zugen
2010/0045215 A1 2/2010 Hawker et al.
2010/0071153 A1 3/2010 Genn
2010/0083459 A1 4/2010 Beskow
2010/0095476 A1 4/2010 Kim et al.
2010/0162515 A1 7/2010 Stephens
2010/0175217 A1 7/2010 Conrad
2010/0175219 A1 7/2010 Soen et al.
2010/0224073 A1 9/2010 Oh et al.
2010/0229322 A1 9/2010 Conrad
2010/0229336 A1 9/2010 Conrad
2010/0229338 A1 9/2010 Conrad
2010/0242222 A1 9/2010 Conrad
2010/0242421 A1 9/2010 Conrad et al.
2010/0293745 A1 11/2010 Coburn
2011/0023262 A1 2/2011 Conrad

(56) References Cited

U.S. PATENT DOCUMENTS

| | | | | |
|---|---|---|---|---|
| 2011/0138568 | A1* | 6/2011 | Hsu | A47L 5/24 15/339 |
| 2011/0219573 | A1 | 9/2011 | Conrad | |
| 2011/0314629 | A1 | 12/2011 | Conrad | |
| 2012/0000030 | A1 | 1/2012 | Conrad | |
| 2012/0030895 | A1 | 2/2012 | Chong et al. | |
| 2012/0030896 | A1 | 2/2012 | Crouch et al. | |
| 2012/0159734 | A1 | 6/2012 | Jujiwara | |
| 2012/0222235 | A1 | 9/2012 | Lenkiewicz et al. | |
| 2012/0222245 | A1 | 9/2012 | Conrad | |
| 2012/0272472 | A1 | 11/2012 | Conrad | |
| 2013/0091660 | A1 | 4/2013 | Smith | |
| 2013/0091661 | A1 | 4/2013 | Smith | |
| 2013/0091812 | A1 | 4/2013 | Smith | |
| 2013/0091813 | A1 | 4/2013 | Smith | |
| 2013/0104335 | A1 | 5/2013 | Conrad | |
| 2014/0237768 | A1 | 8/2014 | Conrad | |
| 2016/0367094 | A1 | 12/2016 | Conrad | |

FOREIGN PATENT DOCUMENTS

| | | | |
|---|---|---|---|
| CA | 2675723 | A1 | 6/2008 |
| CA | 2658005 | A1 | 9/2010 |
| CA | 2658014 | A1 | 9/2010 |
| CA | 2658381 | A1 | 9/2010 |
| CA | 2658651 | A1 | 9/2010 |
| CA | 2659212 | A1 | 9/2010 |
| CA | 2674056 | A1 | 9/2010 |
| CA | 2674761 | A1 | 9/2010 |
| CA | 2678119 | A1 | 9/2010 |
| CA | 2755305 | A1 | 9/2010 |
| CA | 2755307 | a1 | 9/2010 |
| CA | 2730689 | A1 | 9/2011 |
| CA | 2574291 | C | 8/2013 |
| CA | 2677530 | C | 1/2014 |
| CN | 2524655 | Y | 12/2002 |
| CN | 2534954 | Y | 2/2003 |
| CN | 1626025 | A | 6/2005 |
| CN | 1765283 | A | 5/2006 |
| CN | 1806741 | A | 7/2006 |
| CN | 1911151 | A | 2/2007 |
| CN | 101061932 | A | 10/2007 |
| CN | 101095604 | A | 1/2008 |
| CN | 201101488 | Y | 8/2008 |
| CN | 101288572 | A | 10/2008 |
| CN | 101357051 | A | 2/2009 |
| CN | 101448447 | A | 6/2009 |
| CN | 101489455 | A | 7/2009 |
| CN | 101489457 | A | 7/2009 |
| CN | 101489461 | A | 7/2009 |
| CN | 101822506 | A | 9/2010 |
| CN | 201683850 | U | 12/2010 |
| CN | 102256523 | A | 11/2011 |
| CN | 202173358 | U | 3/2012 |
| CN | 101631494 | B | 4/2012 |
| CN | 202699035 | U | 1/2013 |
| CN | 103040412 | A | 4/2013 |
| CN | 103040413 | A | 4/2013 |
| CN | 103169420 | A | 6/2013 |
| CN | 203724037 | U | 7/2014 |
| DE | 3734355 | C2 | 6/1989 |
| DE | 3743083 | C2 | 8/1997 |
| DE | 112007003039 | T5 | 10/2009 |
| DE | 112007003052 | T5 | 1/2010 |
| DE | 112010001135 | T5 | 8/2012 |
| EP | 0489468 | A1 | 6/1992 |
| EP | 887040 | A1 | 12/1998 |
| EP | 1674009 | A2 | 6/2006 |
| EP | 1771104 | B1 | 9/2008 |
| EP | 966912 | B1 | 3/2010 |
| EP | 2049000 | B1 | 6/2011 |
| EP | 2201875 | B1 | 4/2013 |
| EP | 1629758 | B1 | 10/2013 |
| FR | 2812531 | B1 | 11/2004 |
| GB | 2163703 | A | 3/1986 |
| GB | 2365324 | B1 | 7/2002 |
| GB | 2458243 | B | 4/2012 |
| JP | 2000140533 | A1 | 5/2000 |
| JP | 2005040246 | A1 | 2/2005 |
| JP | 2005087508 | Y | 4/2005 |
| JP | 2009261501 | A | 11/2009 |
| JP | 2010227287 | A | 10/2010 |
| WO | 9619294 | A1 | 6/1996 |
| WO | 0078546 | A1 | 12/2000 |
| WO | 2004069021 | A1 | 8/2004 |
| WO | 2005089618 | A3 | 2/2006 |
| WO | 2006026414 | A3 | 8/2007 |
| WO | 2007104138 | A1 | 9/2007 |
| WO | 2007104238 | A1 | 9/2007 |
| WO | 2008009883 | A1 | 1/2008 |
| WO | 2008009887 | A1 | 1/2008 |
| WO | 2008009888 | A1 | 1/2008 |
| WO | 2008009890 | A1 | 1/2008 |
| WO | 2007084699 | A3 | 2/2008 |
| WO | 2008017802 | A1 | 2/2008 |
| WO | 2008035032 | A2 | 3/2008 |
| WO | 2008070966 | A1 | 6/2008 |
| WO | 2008070980 | A1 | 6/2008 |
| WO | 2009026709 | A1 | 3/2009 |
| WO | 2010102396 | A1 | 9/2010 |
| WO | 2010102410 | A1 | 9/2010 |
| WO | 2010102411 | A1 | 9/2010 |
| WO | 2011054106 | A1 | 5/2011 |

OTHER PUBLICATIONS

Written Opinion, received in connection to corresponding International Patent Application No. PCT/CA2010/000342, dated Jun. 17, 2010.

International Preliminary Report on Patentability, received in connection to corresponding International Patent Application No. PCT/CA2010/000342, dated Sep. 13, 2011.

TotalPatent: English machine translation of DE112010001135, published on Aug. 2, 2012.

TotalPatent: English machine translation of DE112007003052, published on Jan. 14, 2010.

TotalPatent: English machine translation of DE112007003039, published on Oct. 29, 2009.

TotalPatent: English machine translation of JP2010227287, published on Oct. 14, 2010.

TotalPatent: English machine translation of JP2009261501, published on Nov. 12, 2009.

TotalPatent: English machine translation of CN1626025, published on Jun. 15, 2005.

TotalPatent: English machine translation of CN203724037, published on Jul. 23, 2014.

TotalPatent: English machine translation of CN202173358, published on Mar. 28, 2012.

TotalPatent: English machine translation of CN201683850, published on Dec. 29, 2010.

TotalPatent: English machine translation of CN103169420, published on Jun. 26, 2013.

TotalPatent: English machine translation of CN103040413, published on Apr. 17, 2013.

TotalPatent: English machine translation of CN103040412, published on Apr. 17, 2013.

TotalPatent: English machine translation of CN102256523, published on Nov. 23, 2011.

TotalPatent: English machine translation of CN101822506, published on Sep. 8, 2010.

TotalPatent: English machine translation of CN101489461, published on Jul. 22, 2009.

TotalPatent: English machine translation of CN101489457, published on Jul. 22, 2009.

TotalPatent: English machine translation of CN101489455, published on Jul. 22, 2009.

TotalPatent: English machine translation of CN101448447, published on Jun. 3, 2009.

(56) References Cited

OTHER PUBLICATIONS

TotalPatent: English machine translation of CN101288572, published on Oct. 22, 2008.
TotalPatent: English machine translation of CN101095604, published on Jan. 2, 2008.
TotalPatent: English machine translation of CN101061932, published on Oct. 31, 2007.
TotalPatent: English machine translation of the Abstract from DE3743083, published on Aug. 7, 1997.
TotalPatent: English machine translation of CN1911151, published on Feburary 14, 2007.

* cited by examiner

PORTABLE SURFACE CLEANING APPARATUS

CROSS REFERENCE TO PREVIOUS APPLICATIONS

This application is a continuation of co-pending U.S. patent application Ser. No. 14/874,544, filed on Oct. 5, 2015, which itself is a continuation of U.S. patent application Ser. No. 13/255,875 filed on Sep. 9, 2011 and is now issued U.S. Pat. No. 9,204,769; which was a national phase entry of application PCT/CA2010/000342 filed on Mar. 9, 2010, and which claimed priority from Canadian patent application no. 2,658,372, which was filed on Mar. 13, 2009, each of which is incorporated herein in its entirety.

FIELD

The specification relates to surface cleaning apparatuses. More specifically, the specification relates to cyclonic surface cleaning apparatuses.

BACKGROUND OF THE INVENTION

The following is not an admission that anything discussed below is prior art or part of the common general knowledge of persons skilled in the art.

Cyclonic vacuum cleaners utilize one or more cyclones that have an associated dirt collection chamber. The dirt collection chamber may be formed in the bottom of a cyclone chamber. A disc or divider may be positioned in the cyclone casing to divide the cyclone casing into an upper cyclone chamber and a lower dirt collection chamber. In it also known to position a dirt collection chamber exterior to a cyclone casing, such as surrounding the cyclone chamber.

SUMMARY OF THE INVENTION

The following introduction is provided to introduce the reader to the more detailed discussion to follow. The introduction is not intended to limit or define the claims.

According to one broad aspect, a surface cleaning apparatus is provided that utilizes a cyclone having an open end, wherein the open end comprises the dirt outlet of the cyclone. A plate, that preferably has a planar surface facing the open end, is positioned facing the open end. For example, the plate may line in a plane that is perpendicular to the longitudinal axis extending through a cyclone chamber and may be spaced from the open end. Accordingly, a gap is provided between the plate and the open and defines a dirt outlet of the cyclone. In accordance with this aspect, the gap has a non uniform length.

For example, the cyclone casing may have a variable length. The portion that have a shorter length define a gap having a increased height. Alternately, or in addition, the plate may be provided with a sidewall on the side of the plate facing the open end of the cyclone. The sidewall may extend part way around the plate. The height of the wall maybe constant or may be variable.

The sidewall is preferably provided on the periphery of the plate. The diameter of the plate is preferably about the same as the diameter of the open end of the cyclone.

In some embodiments, the sidewall of the plate has a constant length. In other embodiments, the sidewall of the plate has a variable length.

In some embodiments, the sidewall of the cyclone has a first end at the open end, the first end has a perimeter, and the gap has a first portion having a first length and a second portion having a second length greater than the first length. The first length and the second length may be constant. Alternately, the first length and the second length may be variable.

In some embodiments, one of the portions extends up to 210° of the perimeter. For example, the second portion may extend up to 210° of the perimeter. In other embodiments, the second portion extends up to 240° of the perimeter.

According to another broad aspect, a surface cleaning apparatus is provided. The surface cleaning apparatus comprises an air flow passage extending from a dirty air inlet to a clean air outlet. A suction motor is positioned in the air flow passage. A cyclone is positioned in the air flow passage. The cyclone comprises an air inlet, an air outlet, an open end, a longitudinal axis and a longitudinally extending sidewall. The side wall has a variable length. A dirt collection chamber is in flow communication with the open end.

In some embodiments, a first portion of the sidewall is longer than a second portion of the sidewall.

In some embodiments, the sidewall has a first end at the open end, the first end has a perimeter, and the first portion comprises up to 240° of the perimeter and the second portion comprises from up to 120° of the perimeter.

In some embodiments, the surface cleaning apparatus further comprises a plate facing the open end. The plate may be spaced from a front end wall of the surface cleaning apparatus. A first portion of the dirt collection chamber may be provided between the plate and the front end wall. Preferably, a second portion of the dirt collection chamber surrounds at least a portion of the cyclone.

According to another broad aspect, another surface cleaning apparatus is provided. The surface cleaning apparatus comprises an air flow passage extending from a dirty air inlet to a clean air outlet. A suction motor is positioned in the air flow passage. A cyclone is positioned in the air flow passage. The cyclone comprises an air inlet, an air outlet, an open end, a longitudinal axis and a longitudinally extending sidewall. A plate is provided having a cyclone side facing the open end. The plate is positioned to define a gap between the plate and the open end of the cyclone. The plate has a plate sidewall extending towards the open end. A dirt collection chamber is in flow communication with the open end.

In some embodiments, the plate sidewall extends part way around the plate. In some embodiments, the sidewall of the plate has a constant length. In other embodiments, the sidewall of the plate has a variable height.

Any of the surface cleaning apparatuses described herein may comprise a portable vacuum cleaner, and preferably, a hand vacuum cleaner. The portable vacuum cleaner may be removably mountable to an upright vacuum cleaner.

It will be appreciated that an embodiment may contain one or more of features set out in the examples.

BRIEF DESCRIPTION OF THE DRAWINGS

In the detailed description, reference will be made to the following drawings, in which.

DETAILED DESCRIPTION OF THE INVENTION

Figure 1:
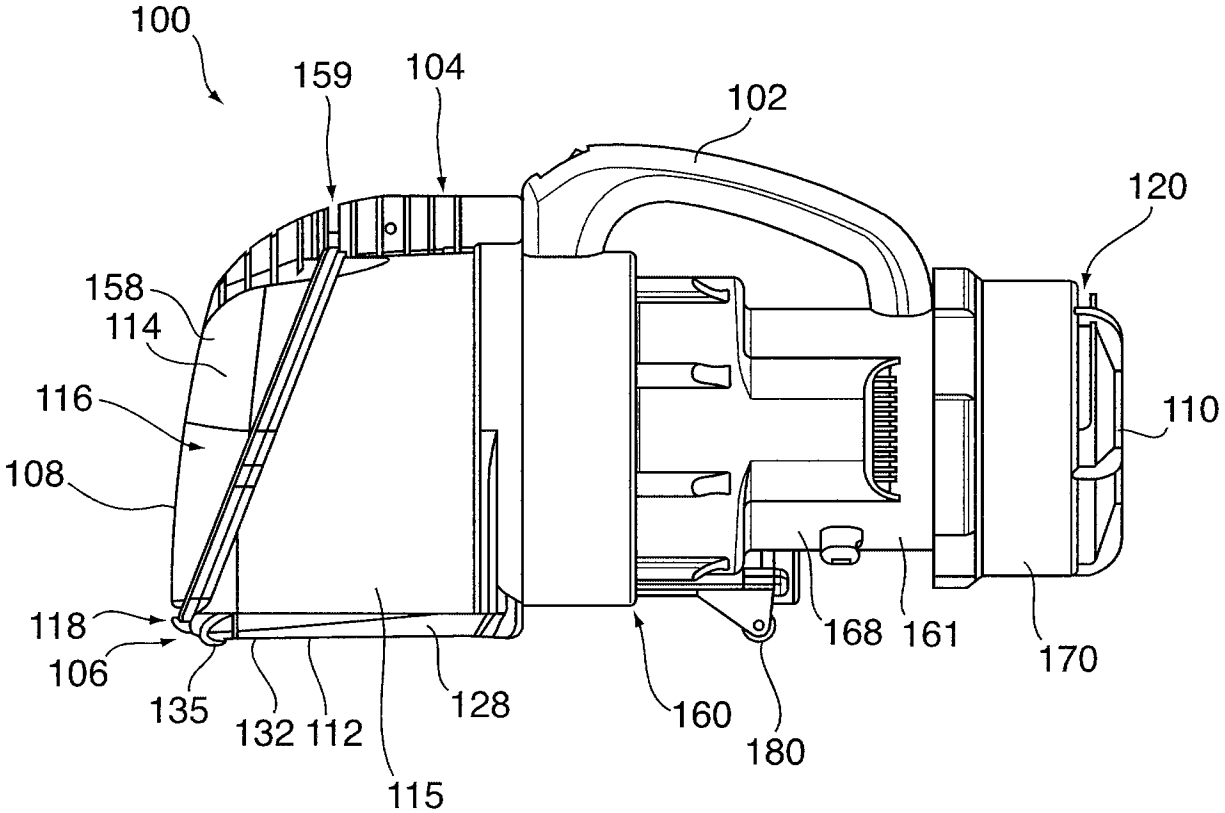
FIG. 1 is a side plan view of an example of a hand vacuum cleaner.
Figure 2:
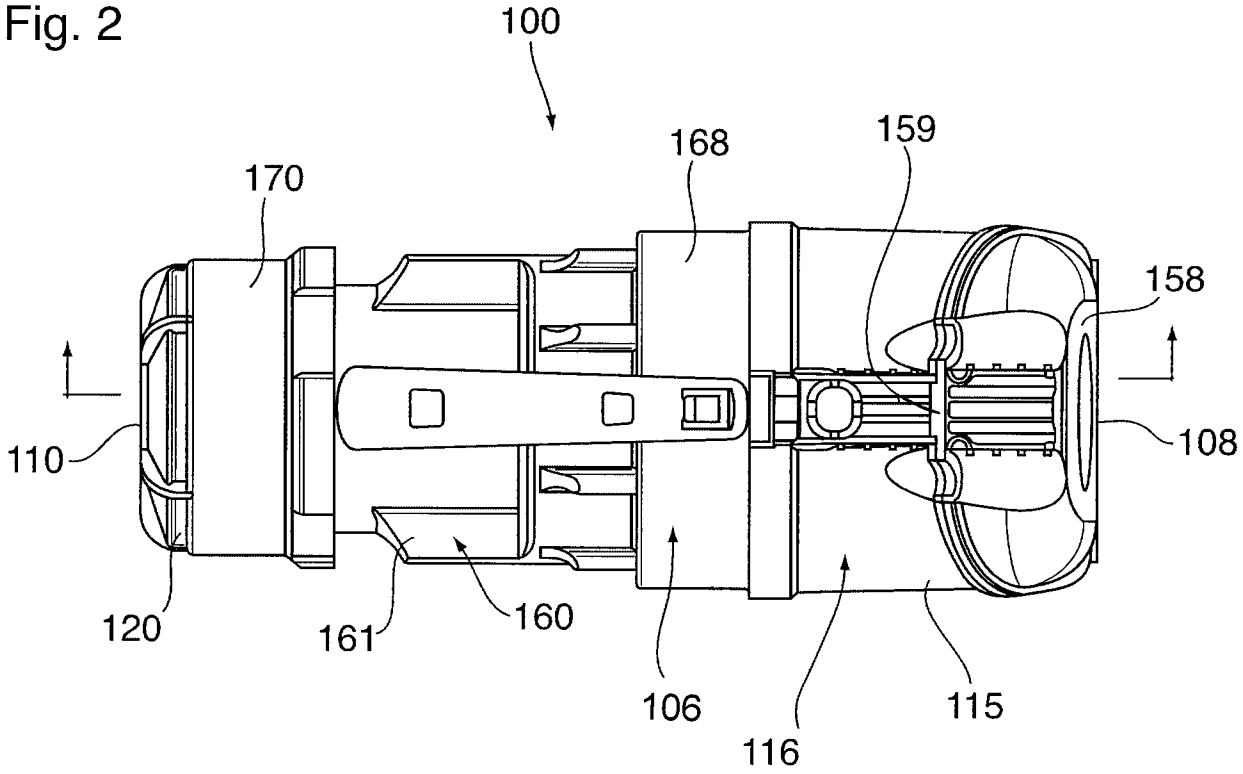
FIG. 2 is a top plan view of the hand vacuum cleaner of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Referring to FIGS. 1 to 7, a first example of a surface cleaning apparatus 100 is shown. Preferably, the surface cleaning apparatus 100 (also referred to herein as cleaner 100 or vacuum cleaner 100) is a portable vacuum cleaner 100, such as a hand vacuum cleaner 100 as shown. The hand vacuum cleaner 100 is movable along a surface to be cleaned by gripping and maneuvering handle 102. In alternate embodiments, the surface cleaning apparatus 100 may be another type of surface cleaning apparatus, such as a stick-vac, an upright vacuum cleaner, or a canister vacuum cleaner.

The exemplified embodiments are hand vacuum cleaners. The design for a cyclone and facing plate having a gap therebetween of non-uniform height may be used in any cyclonic cleaning apparatus. If the feature is used with a portable surface cleaning apparatus such as a hand vacuum cleaner, then the portable surface cleaning apparatus may be of any design. For example, as exemplified, the vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110 and may be of any design. The vacuum cleaner 100 may be of various configurations (e.g., different positioning and orientation of the cyclone unit and the suction motor and differing cyclone units that may comprise one or more cyclones and one or more filters) and may use any type of nozzle or position of the nozzle.

In the example shown, the vacuum cleaner 100 comprises a nozzle 112, which may be of any design, and a cyclone unit 114, which together form a surface cleaning head 116 of the vacuum cleaner 100. As exemplified, the surface cleaning head 116 is preferably provided at the front 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Cyclone unit 114 is provided in the airflow passage, downstream of the dirty air inlet 118. In the example shown, the cyclone unit 114 comprises one cyclone 122 positioned in the airflow passage, and one dirt chamber 124. In alternate examples, the cyclone unit 110 may include more than one cyclonic stage, wherein each cyclonic stage comprising one or more cyclones and one or more dirt chambers. Accordingly, the cyclones may be arranged in parallel and/or in sequence.

Figure 6:
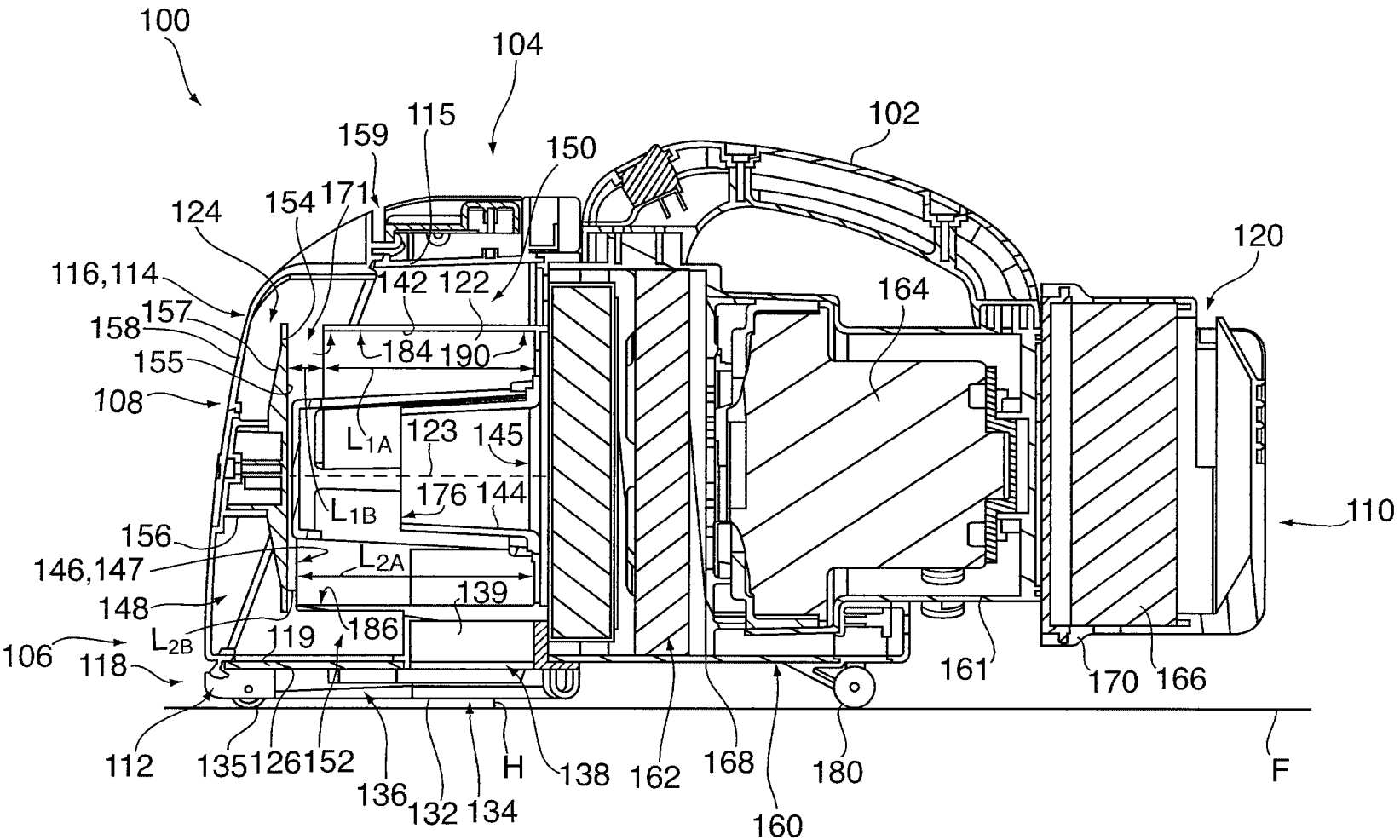
FIG. 6 is a cross section taken along line 6-6 in FIG. 2.
Figure 7:
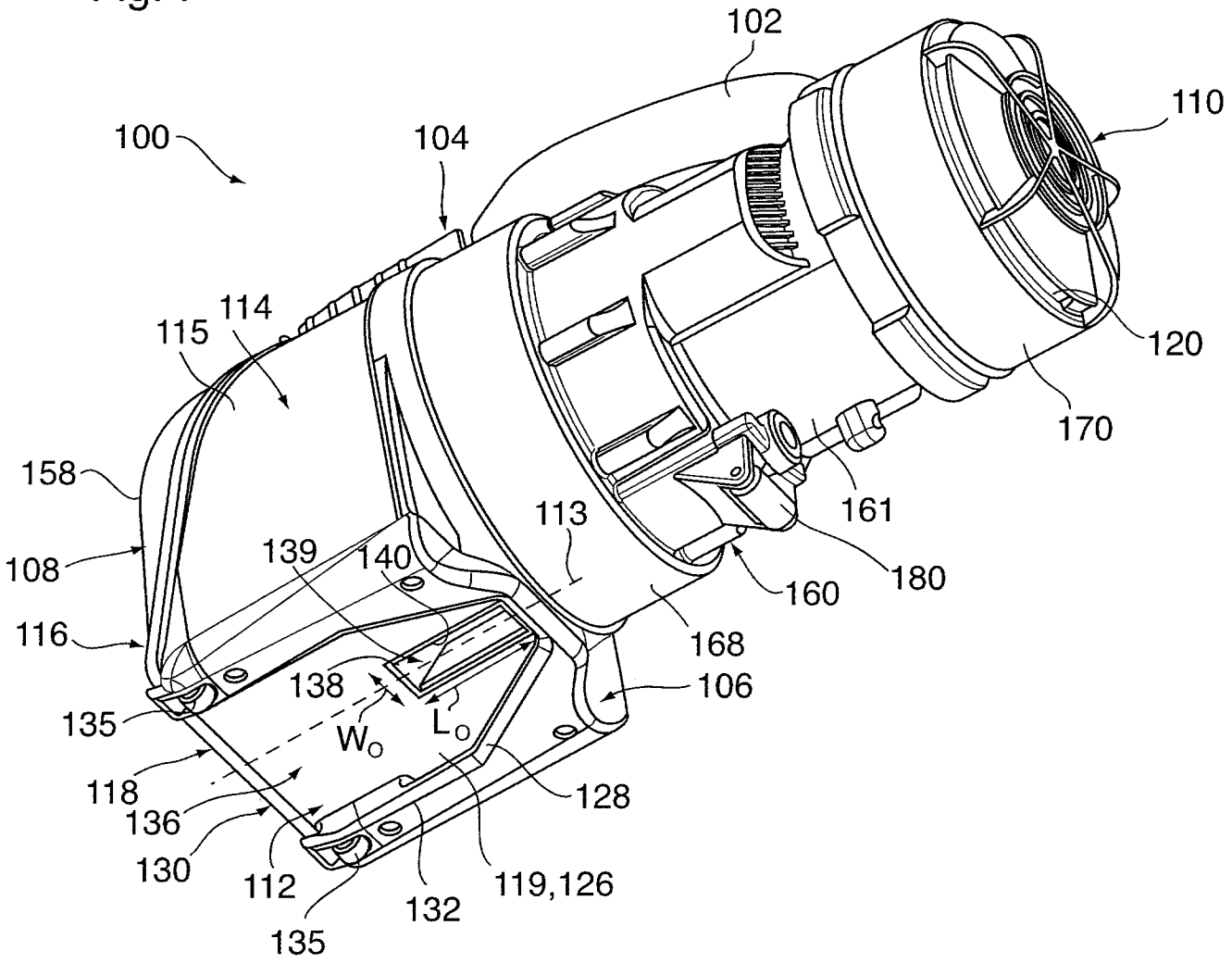
FIG. 7 is a bottom perspective view of the hand vacuum cleaner of FIG. 1.
Figure 8:
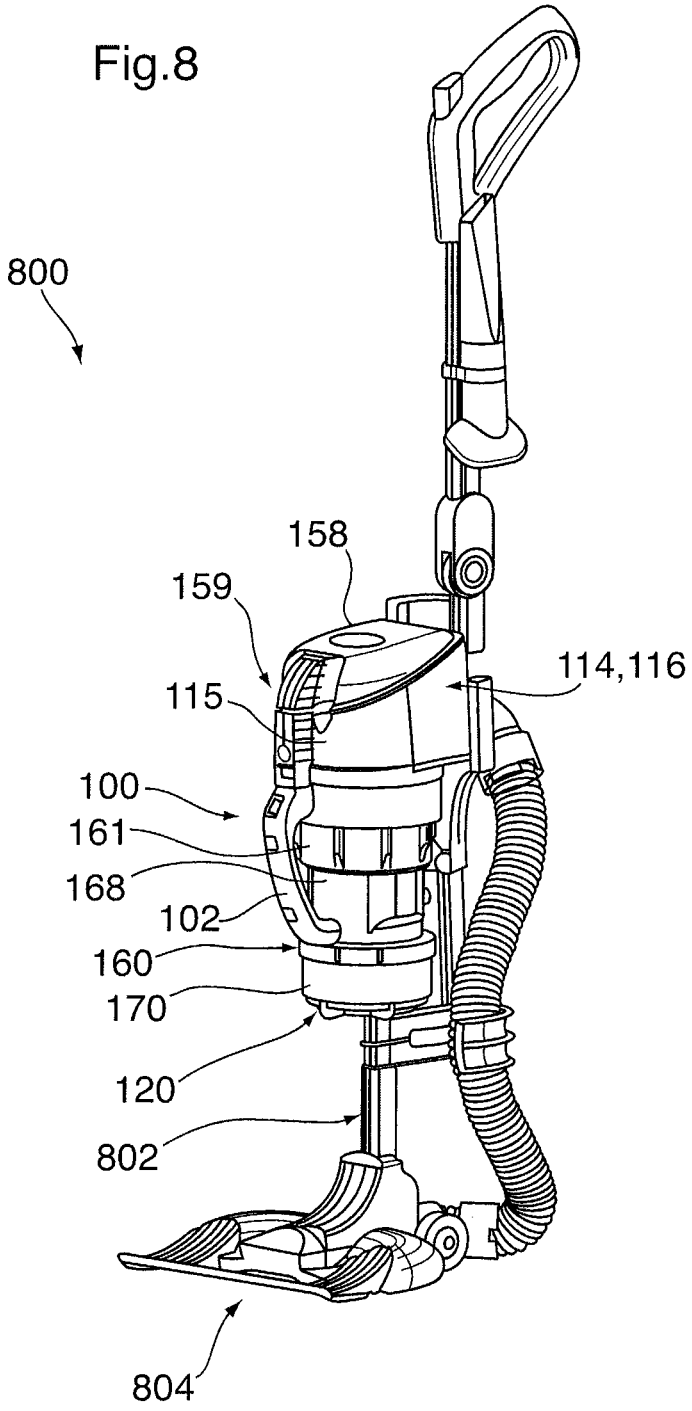
FIG. 8 is a perspective illustration of the surface cleaning apparatus of FIG. 1 mounted to an upright vacuum cleaner.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. Accordingly, as exemplified, nozzle 112 may be on lower surface 117 of cyclone unit 114. In a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
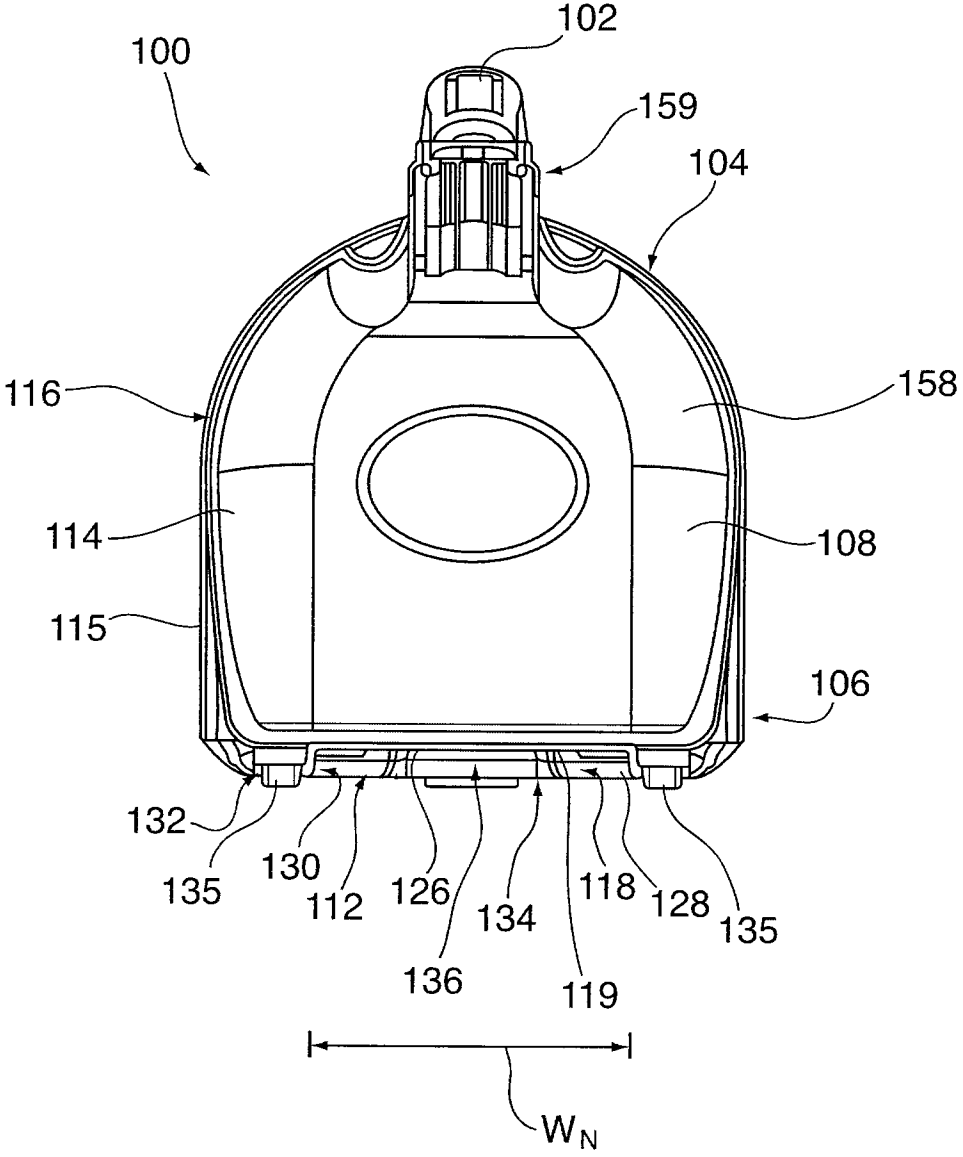
FIG. 3 is a front plan view of the hand vacuum cleaner of FIG. 1.
Figure 4:
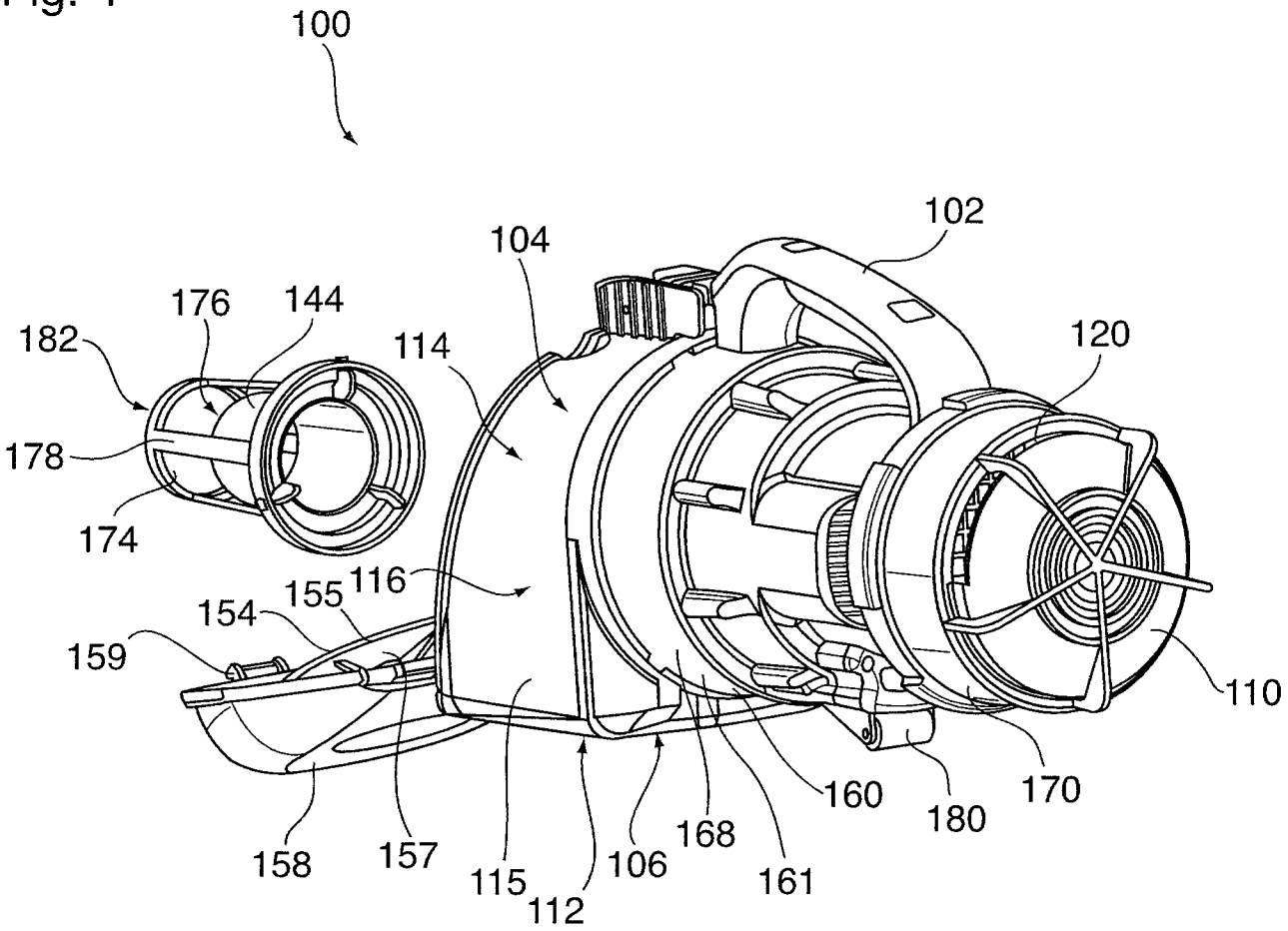
FIG. 4 is a partially exploded rear perspective view of the hand vacuum cleaner of FIG. 1.
Figure 5:
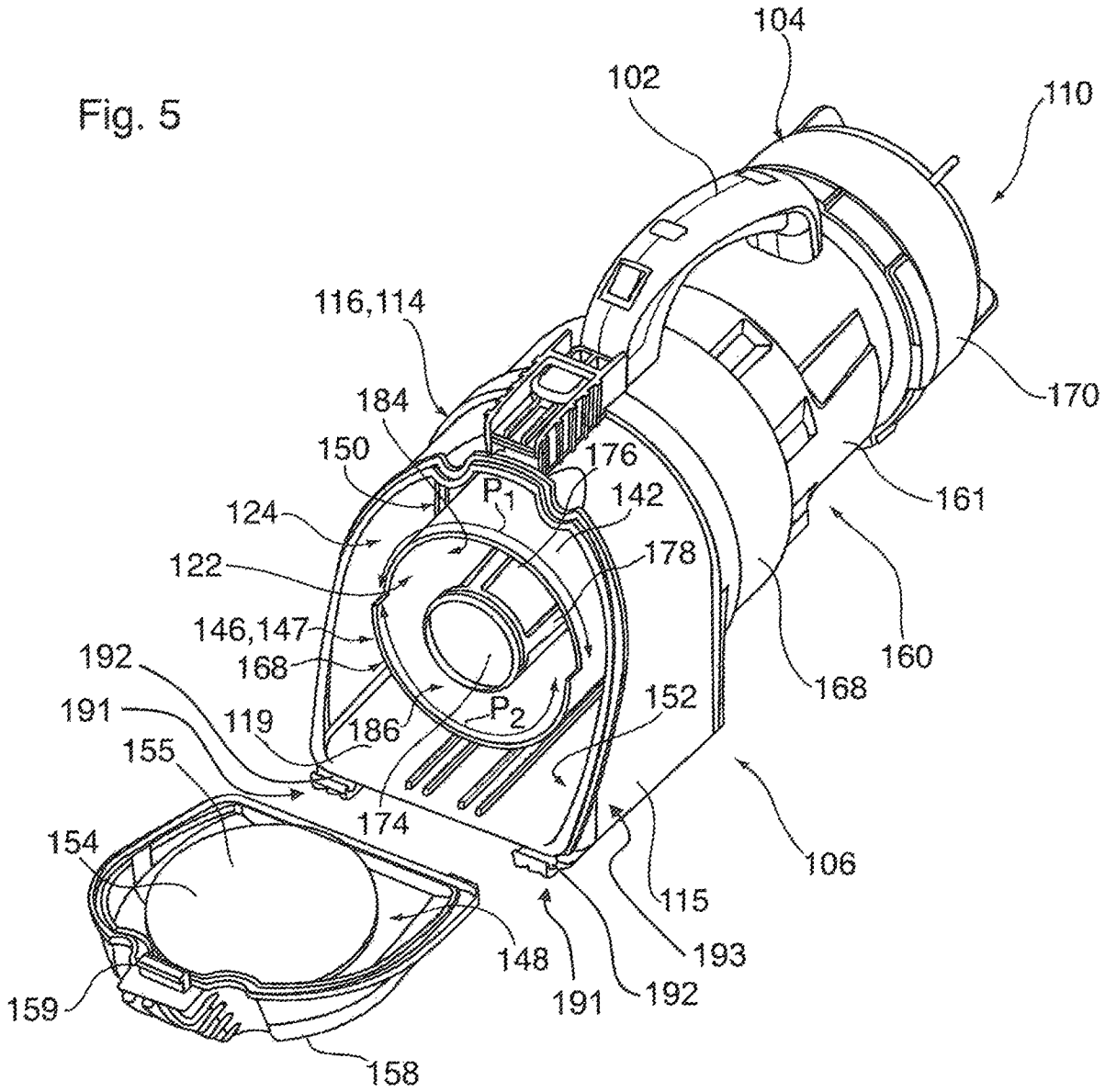
FIG. 5 is a partially exploded front perspective view of the hand vacuum cleaner of FIG. 1.

As shown in FIGS. 3 and 5, nozzle 112 has a width WN, and cyclone unit 114 has a width WC. In the example shown, WN, and WC are about the same. An advantage of this design is that the nozzle may have a cleaning path that is essentially as wide as the hand vacuum itself.

Preferably, nozzle 112 comprises an airflow chamber wherein at least a portion, and preferably a majority, of the lower surface of the chamber is open. In an alternate design, the nozzle may comprise a lower wall, which closes the lower end. Accordingly, nozzle 112 may be of various design and may be an open sided passage or a closed passage.

Nozzle 112 may also share a common wall with another component of cyclone unit 114. As exemplified in FIG. 7, nozzle 112 comprises an upper nozzle wall 126, which defines a closed upper end of the airflow chamber 136. In the example shown, the upper nozzle wall 126 comprises a lower portion 119 of a wall 115 of the cyclone unit.

Preferably, one or more depending walls 128 extend downwardly from the upper nozzle wall 126. The depending wall is preferably generally U-shaped. In one embodiment, depending wall is provided rearward of opening 138. In other embodiments, depending walls may alternately or in addition be provided on the lateral sides of opening 138. It is preferred that depending walls are provided on each lateral side of opening 138 and rearward thereof. Further, depending walls 128 may extend a substantial distance to the front end 108 and, preferably, essentially all the way to front end 108. The depending walls may be continuous to define a single wall as shown, or may be discontinuous. The depending walls are preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on floor F, lower end 132 of depending wall 128 is spaced a distance H above the floor. Preferably distance H is from 0.01 to 0.175 inches, more preferably from 0.04 to 0.08 inches.

The height of the depending wall (between upper nozzle wall 126 and lower end 132) may vary. In some examples, the depending wall may have a height of between about 0.05 and about 0.875 inches, preferably between about 0.125 and about 0.6 inches and more preferably between about 0.2 and about 0.4 inches. The height of depending wall may vary but is preferably constant.

As exemplified, the open end of the U-shape defines an open side 130 of the nozzle 112, and forms the dirty air inlet 118 of the cleaner 100. In the example shown, the open side 130 is provided at the front of the nozzle 112. In use, when optional wheels 135 are in contact with a surface, the open side 130 sits above and is adjacent a surface to be cleaned (e.g. floor F). Preferably, lower end 132 of depending walls 128 is spaced above floor F. Accordingly, some air may enter nozzle 112 by passing underneath depending wall 132. In such a case, the primary air entry to nozzle 112 is via open side 130 so that dirty air inlet 118 is the primary air inlet, with a secondary air inlet being under depending wall 128. In the example shown, the lower end 132 of the depending wall 128 defines an open lower end 134 of the nozzle 112. The open lower end 134 preferably extends to the front 108 of the cleaner 108, and merges with the open side 130.

In use, the exemplified nozzle has an open lower end 134 that faces a surface to be cleaned. In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from a surface to be cleaned, and the space between the lower end of the depending wall 128 and the surface to be cleaned form a secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 is provided. Preferably, the wheels are located adjacent front 108. Optionally, one or more rear wheels 108 may be provided. In an alternate embodiment, no wheels may be provided.

The upper nozzle wall 126, depending wall 128, and open lower end 134 of the nozzle 112 define an open sided airflow chamber 136 of the nozzle. In use, when wheels 135 are in contact with a horizontal surface, the nozzle 112 and the airflow chamber 136 extend generally horizontally, and preferably linearly along a nozzle axis 113 (see FIG. 7).

An opening 138 is provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with an air inlet 140 of cyclone 122.

Referring to FIGS. 5 and 6, cyclone 122 comprises a longitudinally extending sidewall 142. In the example shown, the longitudinally extending sidewall 142 is substantially cylindrical. The cyclone chamber is located inside chamber wall 142. The cyclone 122 extends along a longitudinal axis 123. Preferably, as shown, axis 123 is parallel to the nozzle axis, and extends generally horizontally when cleaner 100 is in use and wheels 135 are seated on a surface.

Cyclone 122 further comprises an air inlet 140, and an air outlet 145. The cyclone air inlet and cyclone air outlet may be of any configuration known in the art. The cyclone 122 further comprises an open end 147. The open end 147 comprises a dirt outlet 146 of the cyclone 122.

As exemplified, the cyclone air inlet 140 is defined by an aperture in the chamber wall 142. As can be seen in FIG. 5, the inlet passage 139 is at configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, which is in communication with outlet 145. The dirt that is separated from the air exits the cyclone via dirt outlet 146 defined by open end 147, and enters dirt chamber 124.

As exemplified in FIG. 6, a shroud 174 may be provided adjacent outlet passage 144, spaced from and facing the inlet 176 to outlet passage 144. Shroud 174 may be mounted to cyclone 122 via legs 178. In the example shown, shroud 174, and legs 178 form an assembly 182 that is removably mounted in cyclone 122. In some examples, a screen may be mounted around legs 178. Shroud 174 may be of any design.

As noted hereinabove, the open end 147 of the cyclone 122 is in communication with a dirt chamber 124. In the example shown, dirt chamber 124 comprises two portions. A first portion 148 is provided forwardly of the dirt outlet 146. A second portion 150 is concentric with the cyclone 122, and surrounds at least a portion of the cyclone 122. A lower portion 152 of the second portion 150 is below the cyclone. As exemplified, nozzle 112 is positioned below first portion 148, and lower portion 152.

Preferably, the surface cleaning apparatus comprises a plate 154 facing the open end 147 of the cyclone. Preferably, the plate 154 has a cyclone side 155 facing the open end 147, and a dirt bin side 157 facing front wall 158. The cyclone side 155 is preferably planar. For example, as exemplified, cyclone side may be oriented to be perpendicular to the cyclone axis 123. Preferably, plate 123 is spaced for the open end of the cyclone. Preferably, the diameter of plate 154 and the diameter of the open end are about the same. The plate may be slightly smaller and/or slightly larger (e.g., +/−10%).

As shown, plate 154 may be provided in the dirt chamber 124, and is spaced from a front wall 158 at the front 108 of the cleaner. Accordingly, the first portion 148 of dirt chamber 124 is provided between dirt bin side 157 of plate 154 and a front end wall 158 of the surface cleaning apparatus.

Preferably, the plate is positioned to define a gap 171 between the plate 154 and the open end 147 of the cyclone 122. More preferably, the gap has a variable length in the direction of the longitudinal axis 123 of the cyclone 122.

For example, as shown in FIGS. 5 and 6, the sidewall 142 of cyclone 122 has a variable length. That is, as shown, a first portion 184 of the sidewall 142 is longer than a second portion 186 of the sidewall. Accordingly, in this embodiment, the variable length of the sidewall of the cyclone provides the variable length of the gap.

In the embodiment shown, first portion 184 of the sidewall 142 has a first length L1A, and second portion 186 of the sidewall 142 has a second length L2A. Accordingly, the gap has a first length L1B adjacent the first portion 184 of the sidewall, and a second length L2B adjacent the second portion 186 of the sidewall. In the embodiment shown, the second length L2A is greater than the first length L1A. Accordingly, the first length L1B of the gap 171 is greater than the second length L2B of the gap 171.

Preferably, the first length L1A of the first portion 184 and the first length L2A of the second portion are constant. More preferably, the first length L1B of the gap 171 and the second length L2B of the gap 171 are constant. In alternate embodiments, however, one or both of the first length L1B of the gap 171 and the second length L2B of the gap 171 may be variable.

In the exemplified embodiment, sidewall 142 has a first end 188 at open end 147, and a second end 190 opposed to the first end. The first end has a perimeter. Preferably, in embodiments wherein the first length L1A and the second length L2A are constant, one of first portion 184 and second portion 186 extends up to 210° of the perimeter. For example, the first portion 184 may extend up to 210° of the perimeter. For example, as shown, first portion 184 extends for about 180° of the perimeter (indicated by arrow P1) and the second portion 186 extends for about 180° of the perimeter (indicated by arrow P2).

In alternate embodiments, wherein the first length L1A and/or the second length L2B are variable, one of first portion 184 and second portion 186 preferably extends up to 240° of the perimeter. For example, the first portion may comprise 240° of the perimeter, and the second portion may comprise 120° of the perimeter. In such an embodiment, the face of the wall facing the open end of the cyclone may extend upwardly at an angle.

It will be appreciated that in alternate embodiments, a cyclone 122 having a variable length may be useful, even if a plate 154 is not provided.

Figure 9:
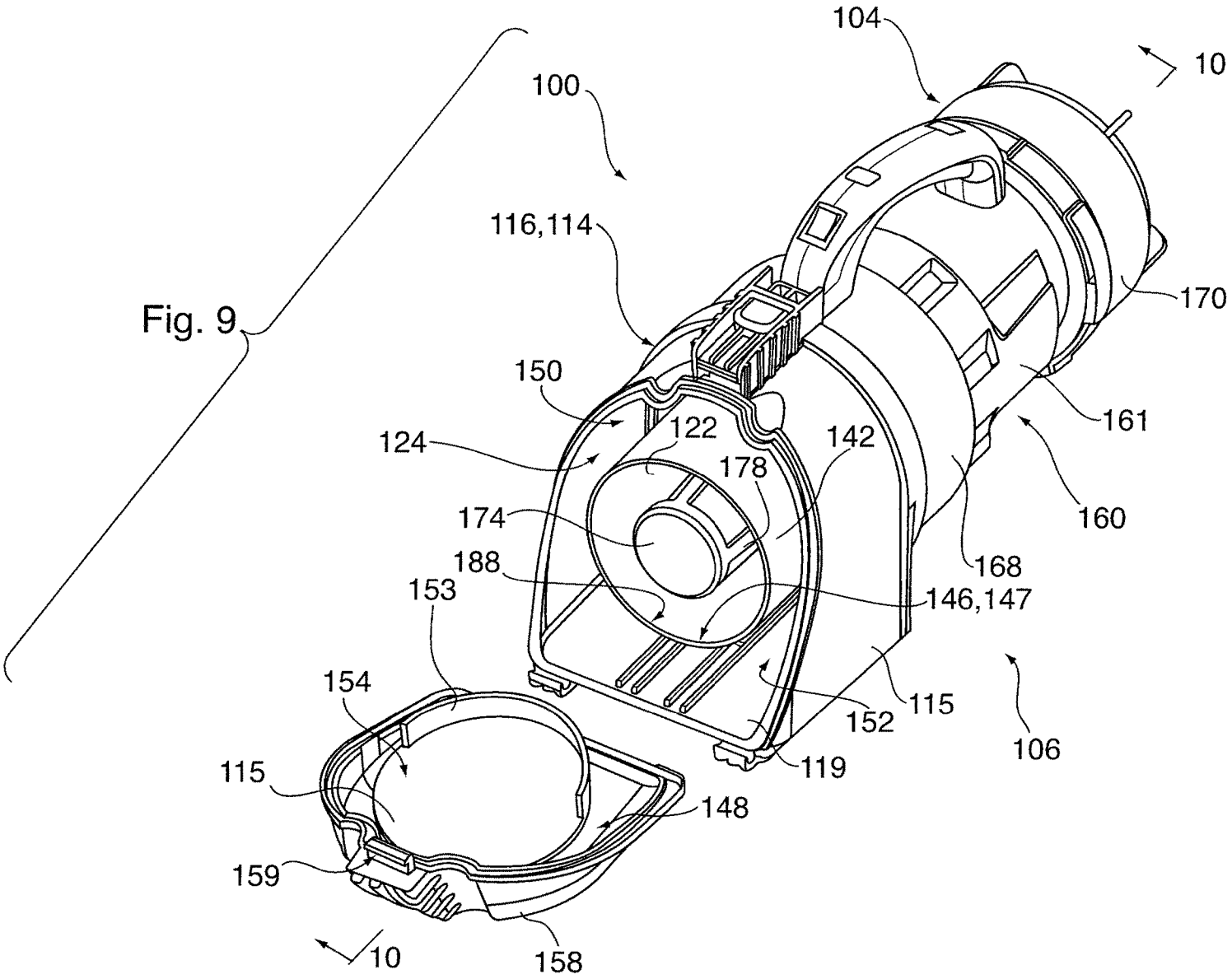
FIG. 9 is a partially exploded front perspective view of an alternate embodiment of a hand vacuum cleaner; and, FIG. 10 is a cross section taken along line 10-10 in FIG. 9.
Figure 10:
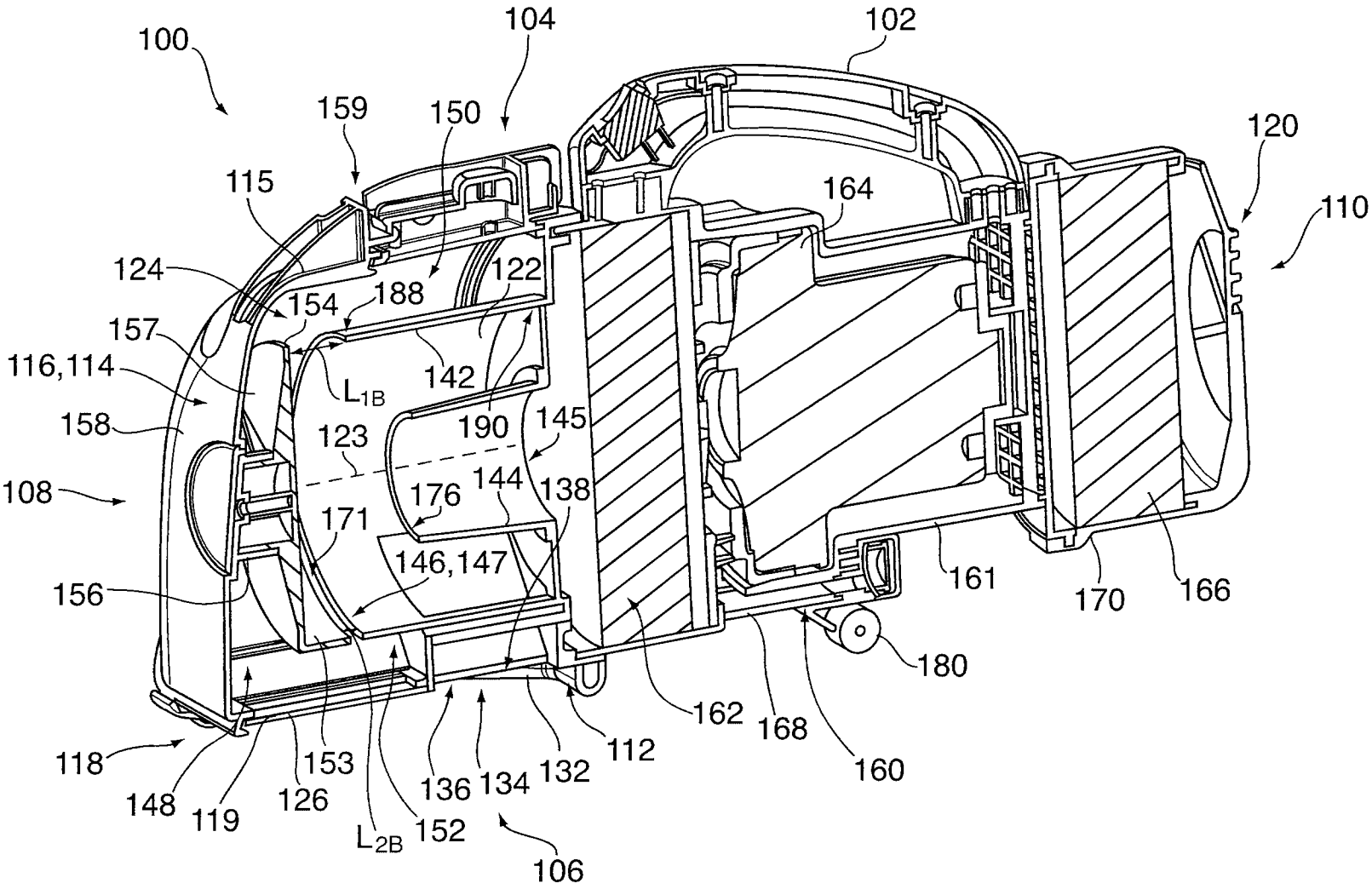

Alternately or in addition, as exemplified in FIGS. 9 and 10, the plate 154 may have a plate sidewall 153 extending towards the open end 147. Preferably, the plate sidewall 153 is at the periphery of the plate. In the embodiment shown, the plate sidewall 153 extends part way around the plate 154. Accordingly, in this embodiment, the space between the plate sidewall and the open end of the cyclone defines the variable length of the gap, and gap 171 has a first length L1B between the plate 154 and the end 188 of cyclone 122, and a second length L2B between the sidewall 153 and the end 188 of cyclone 122 that is less than the first length L1B.

In some embodiments, as shown, the sidewall 153 of the plate 154 has a constant length.

In a alternate embodiments, the plate sidewall 154 may extend all the way around the plate 154, and may have a variable length.

Plate 154 may be mounted by any means to any component in cyclone unit 114. As exemplified, the separation plate is mounted on an arm 156, which extends from a front wall 158 at the front 108 of the cleaner 100.

Cyclone unit 114 may be emptied by any means known in the art. For example, one of the ends of the cyclone unit 114 may be openable. As exemplified in FIGS. 4 and 5, front wall 158 is pivotably mounted to the cyclone unit wall 115, such that cyclone unit 114 may be opened, and dirt chamber 124 may be emptied. When front wall 158 is pivoted away from the remainder of the cyclone unit 114, separation plate 154 and arm 156 also pivot away from the remainder of the cyclone unit. A latch 159 is provided, which secures front wall 158 to wall 115. In alternate examples, front wall 158 may be removable from cyclone unit wall 115 or the opposed end of the cyclone unit 114 may be openable. As exemplified in FIG. 5, front wall 158 is a removably mounted openable door. In the illustrated example, the air treatment member 114 has a plurality of arm members 191. Each arm member 191 has a recess 192 therein. The arm members 191 are provided at a hinge side 193 of the outer wall 115 of the air treatment member 114, and a portion of each arm member 191 having the recess 192 extends forward of the hinge side 193 of the outer wall 115. The openable door 158 is pivotably mounted to the arm members 191. The openable door 158 is removably seated in the recesses 192 of the arm members 191, whereby the openable door 158 is removably mounted to the air treatment member 114.

The clean air exiting cyclone 122 passes through outlet passage 144, exits surface cleaning head 116, and passes into the cleaner body 160. The air exiting the cyclone may be subjected to one or more treatment stages (e.g., cyclonic and/or filtration). In the example shown, a cleaner body 160 is positioned rearward of the surface cleaning head 116. The cleaner body comprises a housing 161, which preferably houses an optional pre-motor filter assembly 162, a suction motor 164, and an optional post-motor filter 166.

In the exemplified embodiments, the vacuum cleaner has a linear configuration. Accordingly, pre-motor filter assembly 162 is preferably provided in the airflow path adjacent and downstream of the outlet passage 144. Pre-motor filter assembly 162 serves to remove remaining particulate matter from air exiting the cyclone 122, and may be any type of filter, such as a foam filter. One or more filters may be used, as shown. If the vacuum cleaner is of a non-linear configuration, then pre-motor filter assembly 162 need not be located adjacent outlet passage 144.

Suction motor 164 is provided in the airflow path preferably adjacent and downstream of the pre-motor filter 162. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 122 extend in the same direction and are generally parallel. The suction motor 164 may be any type of suction motor. If the vacuum cleaner is of a non-linear configuration, then motor 164 need not be located adjacent pre-motor filter 162.

Post motor filter 166 is provided in the airflow path downstream of, and preferably adjacent, the suction motor 164. Post motor filter serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 comprises a plurality of apertures preferably formed in housing 161.

Preferably, as in the example shown, cleaner body 160 is removably mounted to surface cleaning head 116. For example, cleaner body 160 may be entirely removable from surface cleaning head 116, or pivotably mounted to surface cleaning head 116. Accordingly, cleaner body 160 and surface cleaning head 116 may be separated in order to provide access to the interior of cleaner body 160 or surface cleaning head 116. This may allow pre-motor filter assembly 162 to be cleaned, changed, or serviced, or motor 164 to be cleaned, changed or serviced. Alternately, or in addition, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively. If no filter element is fixedly mounted to cleaning head 116, then cleaning head 116 may be removed and washed with water.

As can be seen in FIG. 6, housing 161 preferably comprises a first portion 168 housing pre-motor filter assembly 162, and suction motor 164, and a second portion 170 housing post-motor filter 166. Second portion 170 is openable, such as by being removably mounted to first portion 168, such that post-motor filter 166 may be cleaned, changed, or serviced.

One or more additional rear wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

As mentioned hereinabove, surface cleaning apparatus 100 is a preferably a portable vacuum cleaner 100, as shown in FIGS. 1 to 7.

The invention claimed is:

1. A hand vacuum cleaner having a front end having a dirty air inlet and a rearwardly positioned clean air outlet, the hand vacuum cleaner comprising:

a) an air flow passage extending from the dirty air inlet to the clean air outlet;

b) a main body comprising a suction motor positioned in the air flow passage, a front end, a rear end of the main body spaced apart from the front end of the main body in a first direction and a handle having a hand grip portion;

c) an air treatment member positioned in the air flow passage upstream from the suction motor, the air treatment member provided at the front end of the hand vacuum cleaner and positioned forwardly of the suction motor, the air treatment member comprising an outer wall and housing an air treatment chamber and dirt chamber, the dirt chamber having an openable door having a latch; and, d) an openable lock securing the door in a closed position, the openable lock comprising a lock release member provided on the outer wall and extending forwardly along the first direction, the openable lock having a forward portion having a member engageable with the latch, wherein the lock release member is positioned forward of the hand grip portion, and wherein the air treatment member has a plurality of arm members, each arm member having a recess therein, and the openable door is pivotably mounted to the arm members and the openable door is removably seated in the recesses of the arm members whereby the openable door is removably mounted to the air treatment member and wherein the arm members are provided at a hinge side of the outer wall of the air treatment member and a portion of each arm member having the recess extends forward of the hinge side of the outer wall.

2. The hand vacuum cleaner of claim 1, wherein the handle extends along a handle axis that is generally parallel to the first direction, and the lock release member extends along a lock release member axis that is aligned with the handle axis.

3. The hand vacuum cleaner of claim 1, wherein the door is pivotally connected to the outer wall by a pivot joint, and the pivot joint and the lock are spaced apart from each other in a second direction that is orthogonal to the first direction on opposed sides of the outer wall of the air treatment member.

4. The hand vacuum cleaner of claim 1, wherein the air treatment member is removably mounted to the main body and the lock is provided on the air treatment member and is removable with the air treatment member from the main body.

5. The hand vacuum cleaner of claim 4, wherein the lock is removable with the air treatment member while the door remains secured in the closed position.

6. The hand vacuum cleaner of claim 5, wherein the door is openable while the air treatment member is attached to the main body and while the air treatment member is removed from the main body.

7. The hand vacuum cleaner of claim 1, wherein the dirt chamber is emptyable by angling the front end of the main body downwardly when the door is in an open position.

8. The hand vacuum cleaner of claim 1, wherein the outer wall of the dirt chamber has a front end defining a dirt chamber perimeter and the openable door has a door perimeter that is generally the same as the dirt chamber perimeter.

9. The hand vacuum cleaner of claim 1, wherein the lock release member is positioned forward of the handle.

10. The hand vacuum cleaner of claim 1, wherein the lock release member is pivotally mounted along a pivot axis that is orthogonal to the first direction.

11. A hand vacuum cleaner having a front end having a dirty air inlet and a rearwardly positioned clean air outlet, the hand vacuum cleaner comprising:

a) an air flow passage extending from the dirty air inlet to the clean air outlet;

b) a main body comprising a suction motor housing containing a suction motor in the air flow passage and having a suction motor axis extending in a forward/rearward direction, a front end, a rear end spaced apart from the front end in the forward/rearward direction and a handle; and, c) a cyclone unit positioned in the air flow passage forward of and upstream from the suction motor and comprising a first cyclonic stage comprising a cyclone chamber having an air inlet, an air outlet at a cyclone chamber first end and a dirt outlet, the dirt outlet is in communication with a dirt chamber external to the cyclone chamber, the dirt chamber having an openable dirt chamber door provided at a front end of the cyclone chamber wherein a projection of the motor axis extends through the first cyclonic stage and the openable dirt chamber door wherein the cyclone unit has a plurality of arm members, each arm member having a recess therein, and the openable door is pivotably mounted to the arm members and the openable door is removably seated in the recesses of the arm members whereby the openable door is removably mounted to the cyclone unit and wherein the cyclone chamber has a sidewall, the arm members are provided at a hinge side of the sidewall and a portion of each arm member having the recess extends forward of the hinge side of the sidewall.

12. The hand vacuum cleaner of claim 11, wherein the projection of the motor axis extends through the cyclone chamber.

13. The hand vacuum cleaner of claim 12, further comprising a pre-motor filter positioned in the air flow passage upstream from the suction motor, the pre-motor filter being disposed between the cyclone chamber and the suction motor, wherein the projection of the motor axis extends through the pre-motor filer.

14. The hand vacuum cleaner of claim 13, further comprising a post-motor filter in the air flow passage downstream from the suction motor, wherein the projection of the motor axis extends through the post-motor filter.

15. The hand vacuum cleaner of claim 14, wherein the main body comprises an openable rear wall wherein access is provided to the post-motor filter when the openable rear wall is in an open position, and the openable rear wall forms a rearmost portion of the main body.

16. The hand vacuum cleaner of claim 15, wherein the projection of the motor axis extends through the openable rear wall.

17. The hand vacuum cleaner of claim 16, wherein the openable rear wall comprises the clean air outlet.

18. The hand vacuum cleaner of claim 11, wherein air travelling through the clean air outlet travels generally parallel to the forward/rearward direction.

19. The hand vacuum cleaner of claim 11, wherein the projection of the motor axis extends through the clean air outlet.

20. The hand vacuum cleaner of claim 14, wherein the projection of the motor axis extends through the dirt chamber.

* * * * *